US007232379B2

(12) United States Patent
Riseley

(10) Patent No.: US 7,232,379 B2
(45) Date of Patent: Jun. 19, 2007

(54) GOLF PUTTER

(76) Inventor: Robert A. Riseley, 256 Linden Ave., Red Hook, NY (US) 12571

( * ) Notice: Subject to any disclaimer, the term of this patent is extended or adjusted under 35 U.S.C. 154(b) by 51 days.

(21) Appl. No.: 10/932,595

(22) Filed: Sep. 2, 2004

(65) Prior Publication Data

US 2005/0130758 A1 Jun. 16, 2005

Related U.S. Application Data

(60) Provisional application No. 60/529,474, filed on Dec. 15, 2003.

(51) Int. Cl.
*A63B 53/02* (2006.01)
*A63B 53/00* (2006.01)

(52) U.S. Cl. ..... 473/305; 473/313; 473/340

(58) Field of Classification Search ..... 473/324–350; D21/736, 740, 741
See application file for complete search history.

(56) References Cited

U.S. PATENT DOCUMENTS

| | | | | | |
|---|---|---|---|---|---|
| 3,625,517 | A | | 12/1971 | Durnack | 473/313 |
| 3,679,207 | A | | 7/1972 | Florian | |
| 3,815,910 | A | * | 6/1974 | Raines | 473/313 |
| 4,163,554 | A | | 8/1979 | Bernhardt | |
| 4,240,636 | A | | 12/1980 | Swenson | |
| 4,508,342 | A | | 4/1985 | Drake | |
| 4,795,153 | A | | 1/1989 | Thomas | |
| 5,209,474 | A | * | 5/1993 | Voyer | 473/297 |
| 5,267,733 | A | * | 12/1993 | Szokola | 473/313 |
| 5,340,104 | A | * | 8/1994 | Griffin | 473/340 |
| 5,431,401 | A | | 7/1995 | Smith | |
| 5,465,959 | A | | 11/1995 | Cheng | |
| 5,709,613 | A | * | 1/1998 | Sheraw | 473/248 |
| 5,830,082 | A | | 11/1998 | White | 473/294 |
| 5,976,025 | A | | 11/1999 | Williams | 473/252 |
| 6,497,626 | B1 | * | 12/2002 | Sundberg | 473/248 |

FOREIGN PATENT DOCUMENTS

| | | | |
|---|---|---|---|
| JP | 05305159 | A * | 11/1993 |
| JP | 07144032 | A * | 6/1995 |
| JP | 2002224252 | A * | 8/2002 |

OTHER PUBLICATIONS

*Gold Club, eg. Putter-Comprises Head with Side Vertical Hitting Surface and Constantly Curved Neck that Connects Head to Lower end of Club Stem*, DERWENT-ACC-NO: 1998-415568; Derwent Week 199836.

* cited by examiner

*Primary Examiner*—Eugene Kim
*Assistant Examiner*—Alvin A. Hunter, Jr.
(74) *Attorney, Agent, or Firm*—Wood, Herron & Evans, L.L.P.

(57) ABSTRACT

A putter effective for use in both conventional strokes and side saddle strokes. The putter includes a shaft having a grip portion at one end and a putter head at an opposite end. The shaft includes a lower forward offset portion and a straight portion. The straight portion defines a majority of the length of the putter and is disposed at an upright lie angle allowing effective use of the putter in the side saddle approach. The forward offset portion allows effective use of the putter with a conventional putting stroke.

5 Claims, 9 Drawing Sheets

GOLF PUTTER

This application claims the benefit of U.S. Provisional Application Ser. No. 60/529,474 filed on Dec. 15, 2003, the disclosure of which is hereby fully incorporated by reference herein.

FIELD OF THE INVENTION

This invention relates to golf clubs. More specifically, this invention relates to an improved golf putter.

BACKGROUND OF THE INVENTION

Conventional putters are used with the golfer facing generally 90° relative to the hole or cup. The ball is placed in front of the golfer's toes and the putter swings back and forth in front of the golfer. Most conventional putters are between about 35 inches and 39 inches in length with a grip affixed to a shaft at one end and a putter head affixed at the opposite end. The shaft extends away from the putter head at a lie angle of approximately 25°–35° relative to vertical. The putter shaft length and lie angle are designed so that the golfer can assume a comfortable position with the putter head positioned at address well in front of the toes of the golfer's shoes.

Another class of putters has emerged relatively recently and is becoming more and more popular. These putters are used in a "side saddle" manner with the golfer facing the hole or cup at address and the putter held and swung at the golfer's side. The ball is placed alongside one of the golfer's feet. These putters have a much more upright lie angle of approximately 10°, and the shaft of the putter may be lengthened significantly beyond the length of a conventional putter. Typically, the shaft of the putter is gripped at one end with one hand and at a more intermediate location with the other hand. The golfer swings the putter with the lower hand and uses the upper hand generally as a pivot. This putting style is especially useful for putts of shorter distances since many golfers feel that the side saddle stroke allows better putter head control and easier alignment.

Many golfers would like to use a conventional putter and conventional putting stroke at longer distances from the cup, while using the side saddle approach at shorter distances from the cup. Unfortunately, if the golfer attempts to use a typical, upright side saddle putter with a conventional stroke, the golfer must assume an awkward stance, for example, placing the ball too close to his or her toes and standing too upright. On the other hand, if the side saddle approach is attempted with a conventional putter, the ball is placed too far away from the golfer because of the conventional lie angle.

Therefore, there is a need for a putter which may be more conveniently and effectively used with both a conventional putting stroke and a side saddle putting stroke.

SUMMARY OF THE INVENTION

The present invention therefore provides a putter adapted to be used effectively with both a conventional stroke, i.e., with the ball placed in front of the golfer's toes, and also a side saddle approach, i.e., with the ball placed aside one of the golfer's feet. To this end, the putter essentially comprises a shaft having a grip portion at one end and a putter head affixed to the opposite end. A forward offset portion, which may be the shaft itself, a hosel portion of the putter head, or any other connecting portion, extends forwardly in a direction generally perpendicular to the face of the putter head. This forward offset portion extends for a short distance above the putter head. In the preferred embodiment, the forward offset portion is a curved portion, however, it may take other shapes as well. The majority of the shaft extends upward from the forward offset portion most preferably at a lie angle of 10°. Most preferably, the lie angle is about 10° from vertical. In addition, the shaft axis also extends at an angle to the rear, that is, away from the front face of the putter. Various advantages of this embodiment include: 1) allowing the golfer to face the hole for an undistorted view of the line of the putt; 2) allowing the golfer to line up behind the ball and look straight down the line of the putt; 3) the putter head will remain on line throughout the entire stroke; and 4) the design enables a smooth takeaway and follow through.

Various additional features, advantages and objectives of the invention will become more readily apparent to those of ordinary skill in the art upon review of the following detailed description of the preferred embodiment, taken in conjunction with the accompanying drawings.

DETAILED DESCRIPTION

Figure 1:
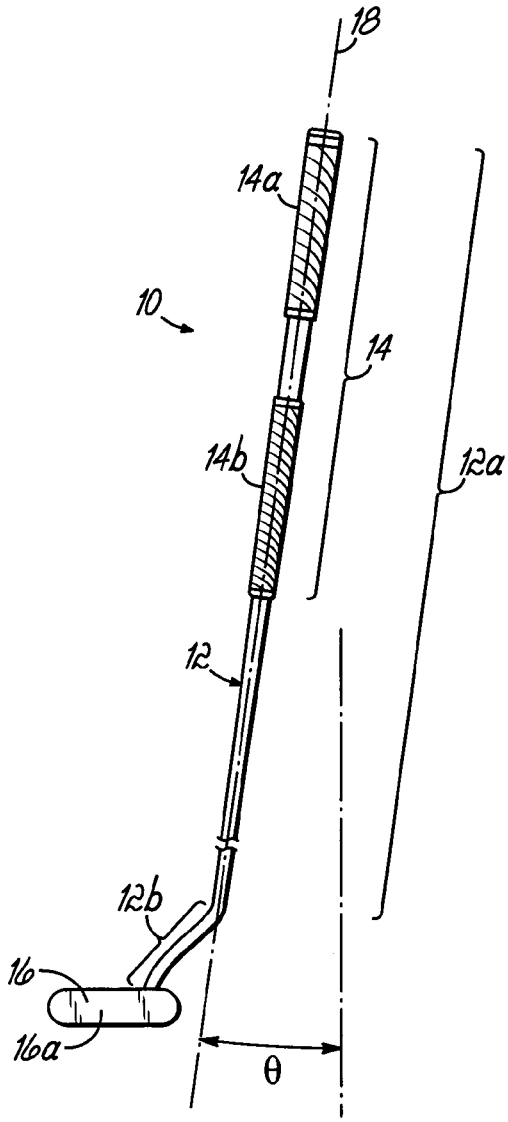
FIG. 1 is a front plan view of a golf club in accordance with the present invention.
Figure 2:
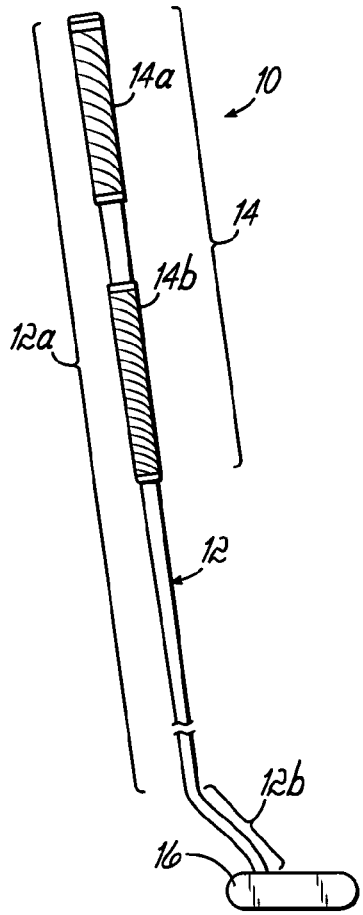
FIG. 2 is a rear plan view of the golf club of FIG. 1.

FIGS. 1 and 2 respectively illustrate the front and rear views of one preferred putter 10 of this invention. It will be appreciated by those of ordinary skill in the art that a putter constructed in accordance with the concepts disclosed herein may be constructed with many different designs and configurations, using many different grip configurations, shafts and putter head configurations. Therefore, Applicant should not be limited to any particular configuration, including that shown in FIGS. 1 and 2.

The putter 10 generally comprises a shaft 12 having a grip portion 14 at one end and a putter head 16 at an opposite end. In the present embodiment, the grip portion 14 is split into two defined portions, i.e., an upper portion 14*a* and a lower portion 14*b*. As will be described below, this allows more convenient use of the putter 10 in a side saddle approach with one hand gripping the upper grip 14*a* and another hand gripping the lower grip portion 14*b*. The shaft 12 includes an upper section 12*a* defining a majority of the length thereof and including an axis 18 disposed at an angle θ relative to vertical. The shaft 12 includes a lower section 12*b* comprising a forward offset portion, which may be simply bent away from the upper shaft section 12*a* or which may be a separate piece, such as a hosel connected with the putter head 16. Angle θ is preferably between 5° and 15° from vertical and, most preferably, at least 10° from vertical with the putter 10 at address as shown in FIG. 1, to comply with USGA regulations. As further shown in FIG. 1, the forward offset section 12*b* moves the putter head 16 in a forward direction parallel to the front face 16*a* and away from the lower part of the shaft axis 18. This places the putter head 16 in a position similar to the position of a conventional putter head if shaft axis had a conventional angle of 25° to 30° from vertical. The preferred length of putter 10 is approximately 43 inches, although this may vary according to the desires of the user. The offset portion 12*b* preferably moves the putter head 16 forward approximately 3–5 inches relative to the bottom of the upper shaft section 12*a*.

Figure 3:
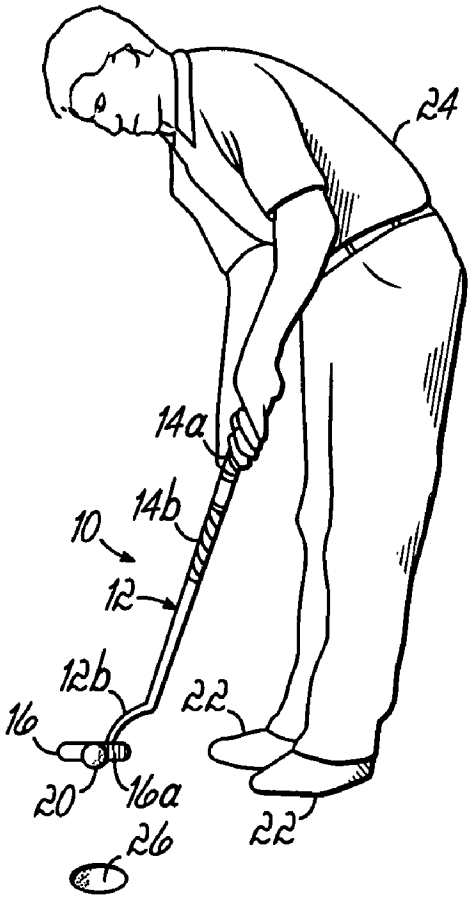
FIG. 3 is a perspective view showing the putter of this invention used by a golfer with a conventional stroke.

As schematically shown in FIG. 3, the putter 10 may be conveniently and effectively used with a conventional putting stroke. Using this stroke, the golf ball 20 is placed in front of the golfer's toes 22 with the golfer 24 facing generally 90° relative to the hole or cup 26. The golfer 24 then swings the putter 10 back and through generally in a direction parallel to the front of their body. In the conventional stroke, the forward offset portion 12*b* allows the golfer 24 to assume a more traditional stance with the ball 20 placed a conventional distance away from the golfer's toes 22.

Figure 4:
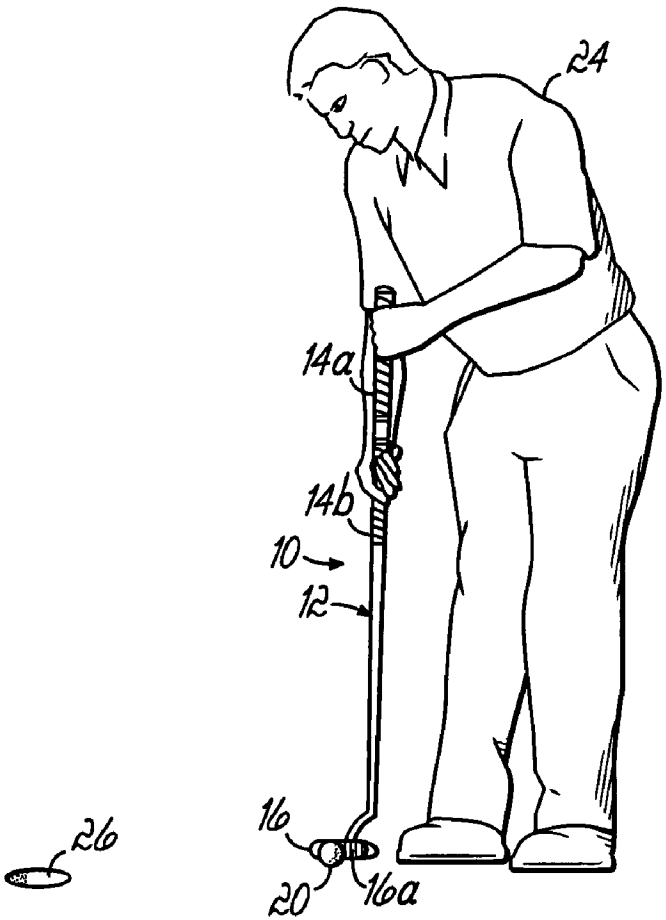
FIG. 4 is a perspective view showing use of the same putter with a side saddle approach.

Referring to FIG. 4, the putter 10 may also be effectively used in a side saddle manner. Using this stroke, the golfer 24 grips the upper grip portion 14*a* with one hand and the lower grip portion 14*b* with the other hand. The ball 20 is placed alongside one foot 26 of the golfer 24 and the golfer 24 swings the putter 10 in a direction generally parallel with that foot 26 alongside the golfer's body. Using this stroke, the golfer 24 is facing the hole or cup 26 and the upright lie angle of the putter 10 allows the golfer 24 to assume the upright stance necessary for effective use of this stroke.

Figure 5:
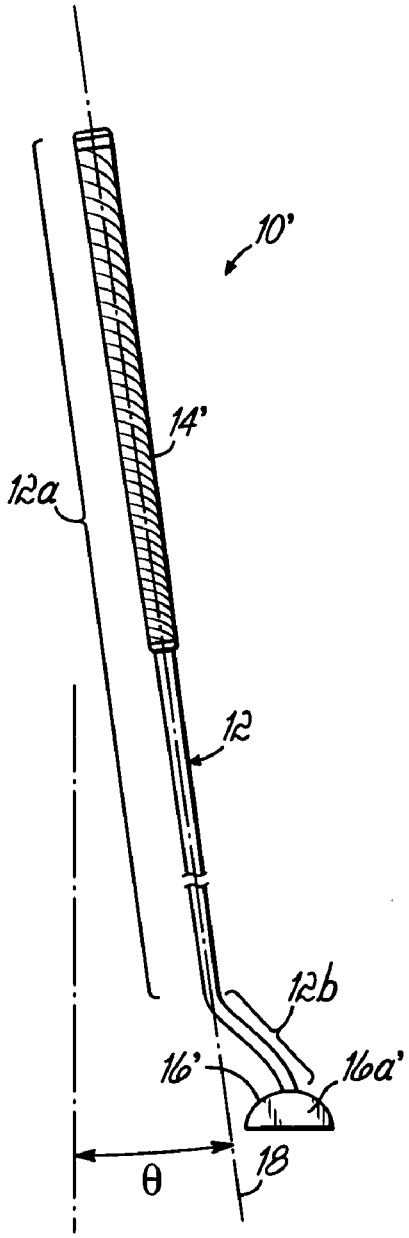
FIG. 5 is a front plan view of one alternative style of golf club constructed in accordance with the present invention.
Figure 6:
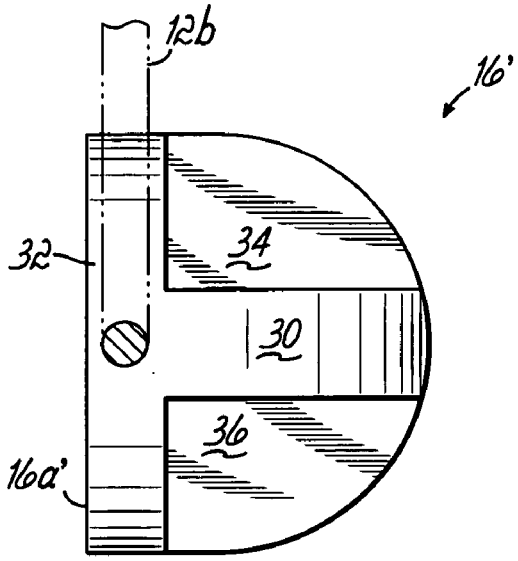
FIG. 6 is a top plan view of the putter head associated with the putter of FIG. 5.
Figure 7:
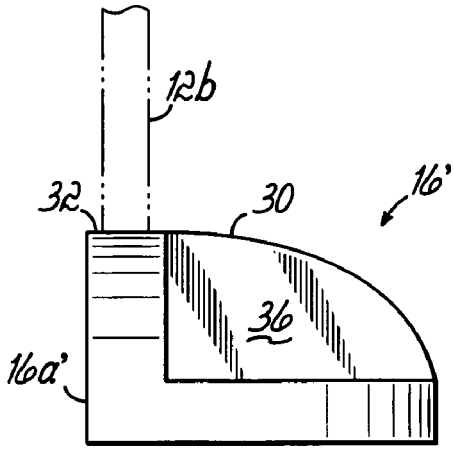
FIG. 7 is a side view of the putter head shown in FIG. 6.
Figure 8:
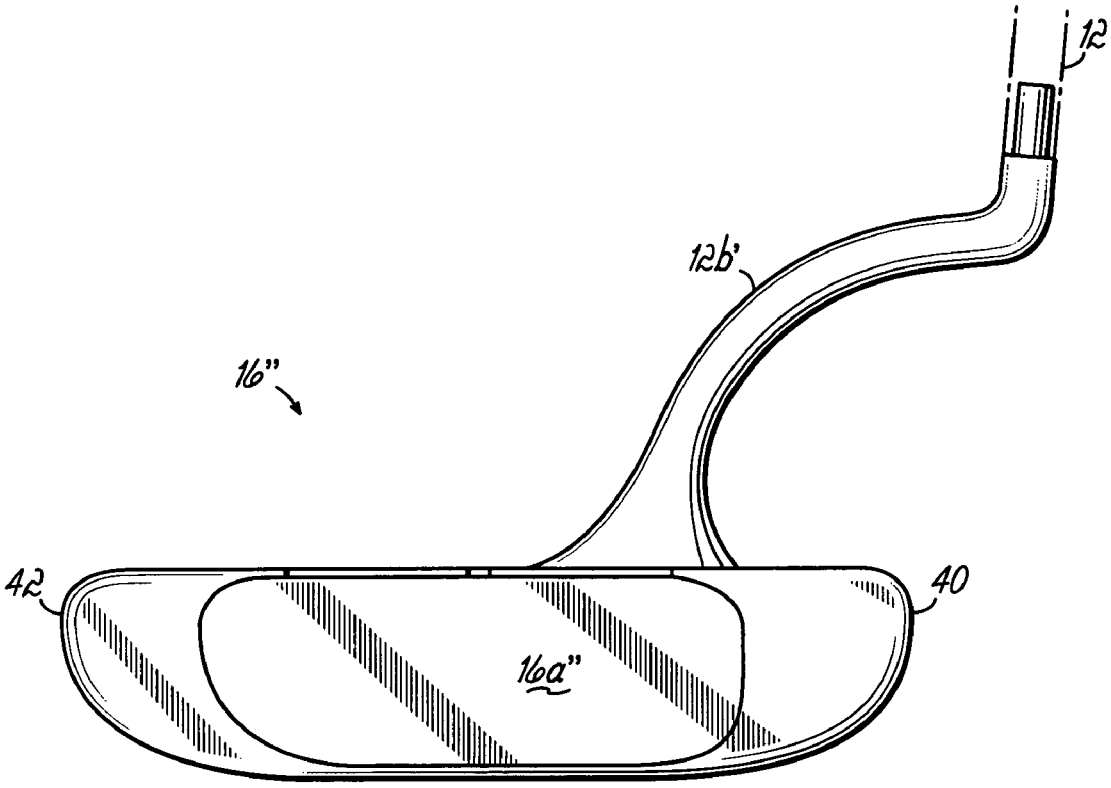
FIG. 8 is a front elevational view of another alternative putter head constructed in accordance with the invention.
Figure 9:
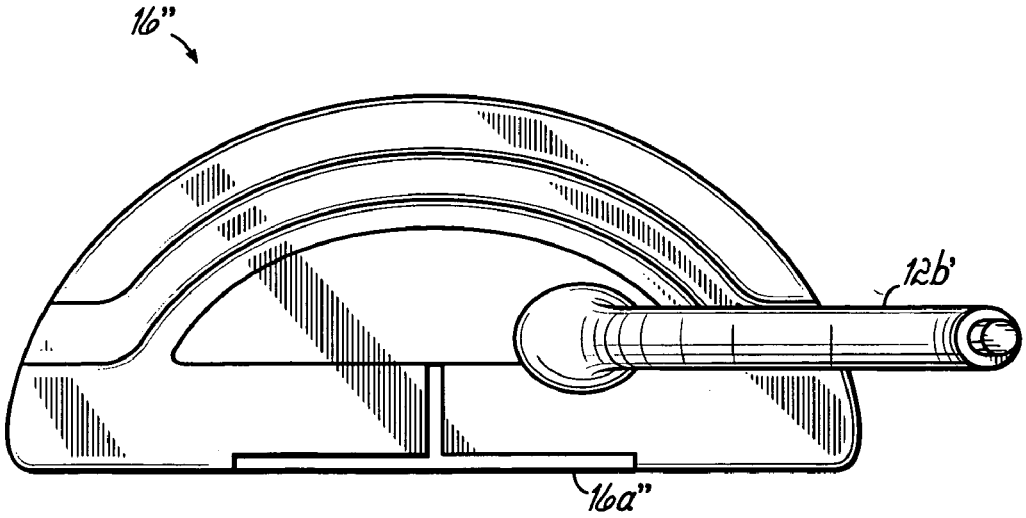
FIG. 9 is a top view of the putter head shown in FIG. 8.

FIGS. 5–7 illustrate one of many different variations of putter capable of using the concepts of the present invention. In FIGS. 5–7, reference numerals with prime marks (') indicate corresponding, but somewhat altered structure, relative to the first embodiment of FIGS. 1–4. New reference numerals indicate new structure. FIG. 5 illustrates a putter 10' having a shaft 12 with a grip portion 14' at one end and a putter head 16' at an opposite end. In this embodiment, grip 14' is formed as one continuous grip. This allows the putter to be used with a conventional swinging-style while anchoring the upper end of the grip in the golfer's abdomen. This helps steady the putter during the swing. The continuous grip 14' allows the golfer to choose any point on the grip that is comfortable for the chosen swing style. As with the first embodiment, shaft 12 includes an upper section 12*a* defining a majority of the length thereof and including an axis 18. Shaft 12 includes a lower section 12*b* comprising a forward offset portion as described in connection with the first embodiment. Angle θ is again defined between vertical and axis 18 as being between about 5° and about 15° from vertical and, most preferably, at least 10° from vertical when putter 10' is at address as shown in FIG. 5. Lower offset shaft section is preferably configured as described in connection with the first embodiment.

The main difference between this alternative embodiment and the first embodiment is that putter 10' is configured as a mallet-style putter having a center-shafted design. In addition, putter 10' is shown as a left-handed putter. Mallet head 16' includes perpendicularly oriented raised sections 30, 32 and a pair of cavities 34, 36 positioned on opposite sides of raised portion 30. Many golfers find such mallet-style putters to be easier to use with both side saddle putting strokes and conventional putting strokes. It will be appreciated that many other putter head configurations may be used in conjunction with the concepts of this invention as well.

Figure 10:
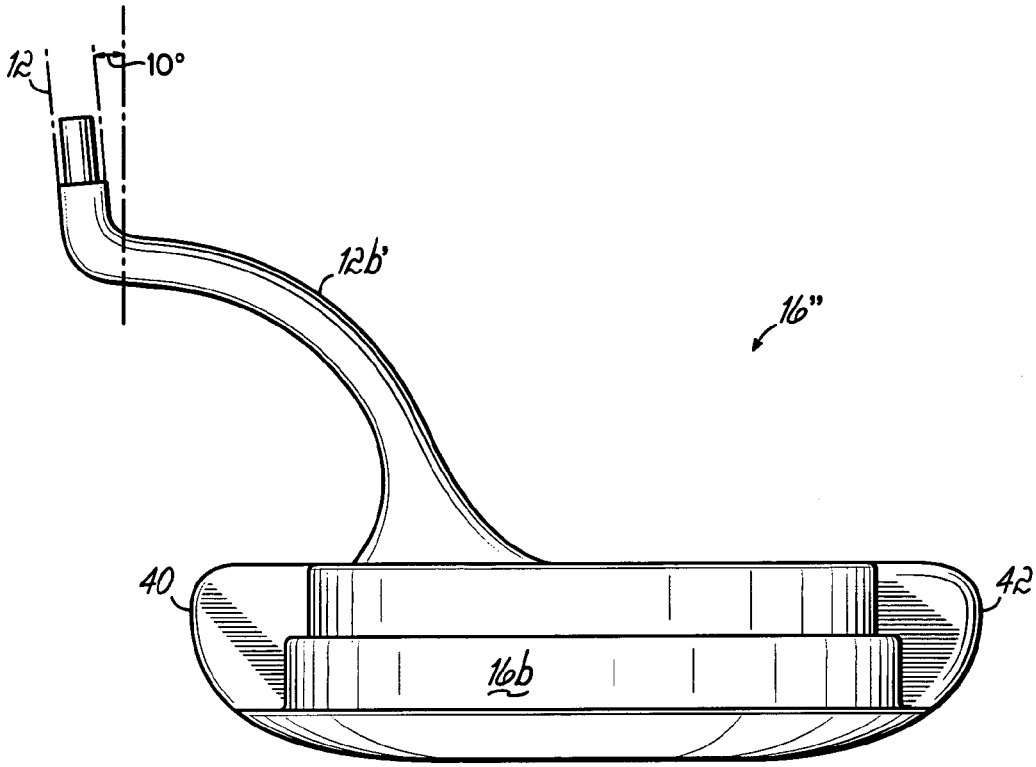
FIG. 10 is a rear elevational view of the putter head shown in FIG. 8.
Figure 11:
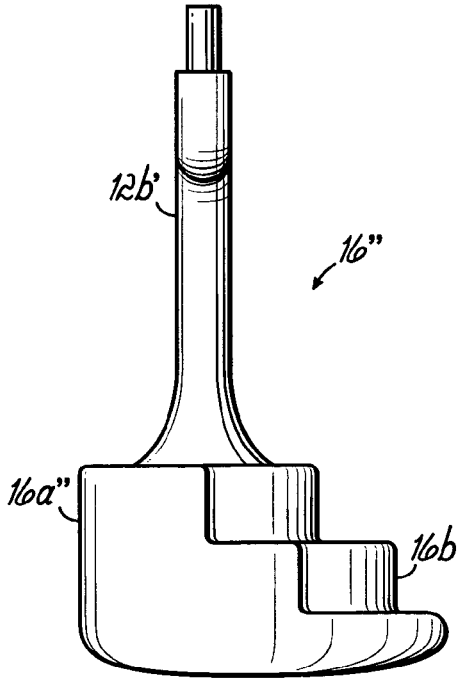
FIG. 11 is a side elevational view of the putter head shown in FIG. 8.
Figure 12:
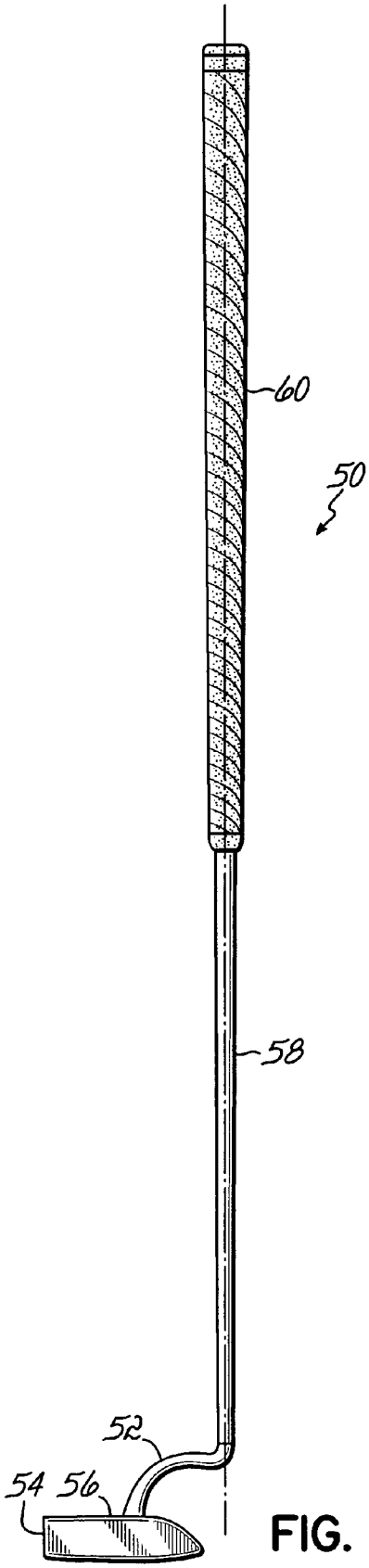
FIG. 12 is a side elevational view of another embodiment of a putter.
Figure 13:
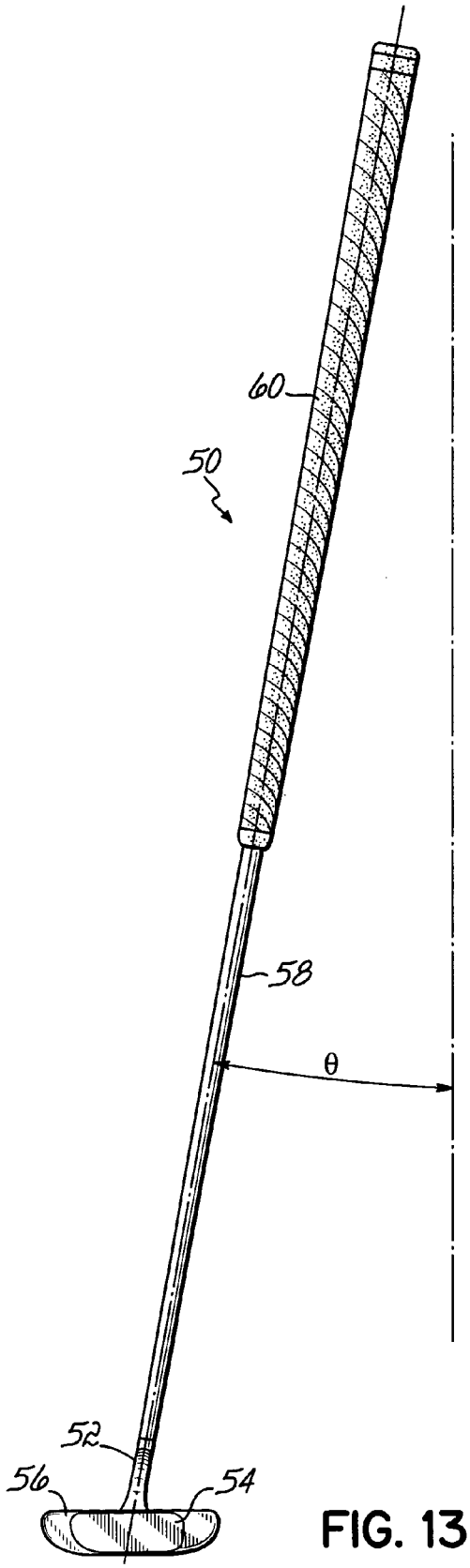
FIG. 13 is a front elevational view of the embodiment shown in FIG. 12.
Figure 14:
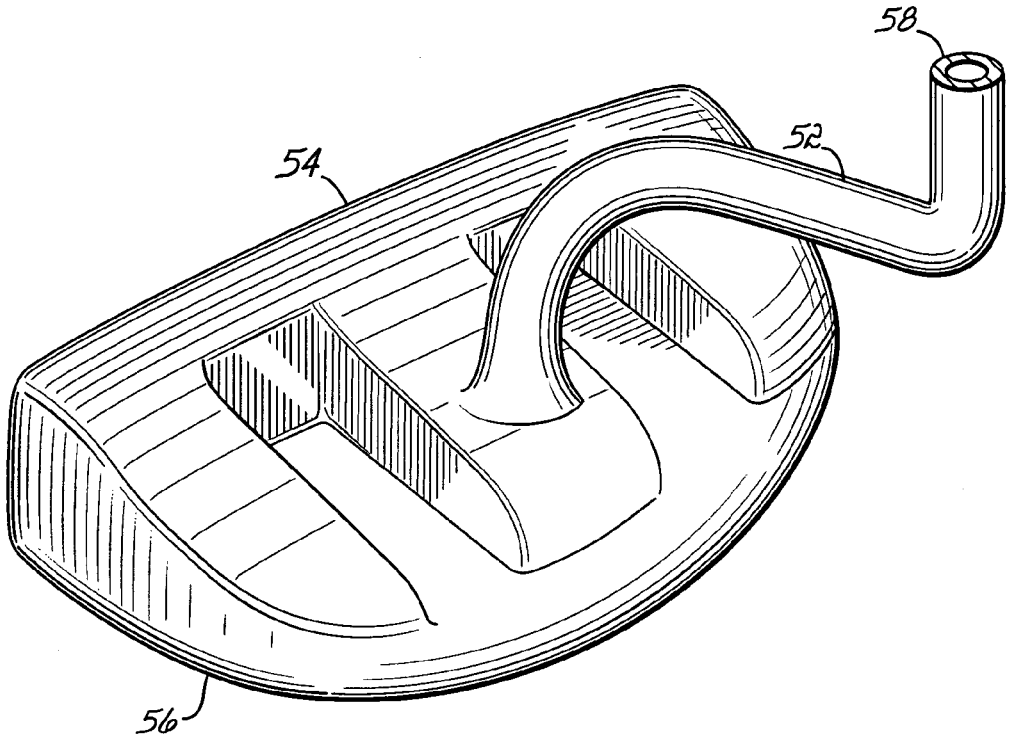
FIG. 14 is a perspective view of the putter head and neck or hosel from FIG. 12.
Figure 15:
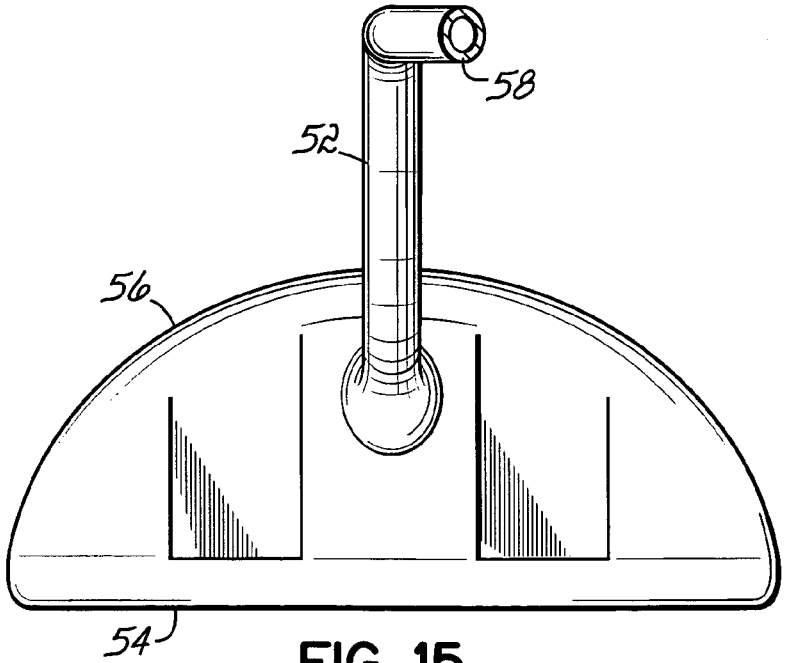
FIG. 15 is a top view of the putter head and neck or hosel from FIG. 14.
Figure 16:
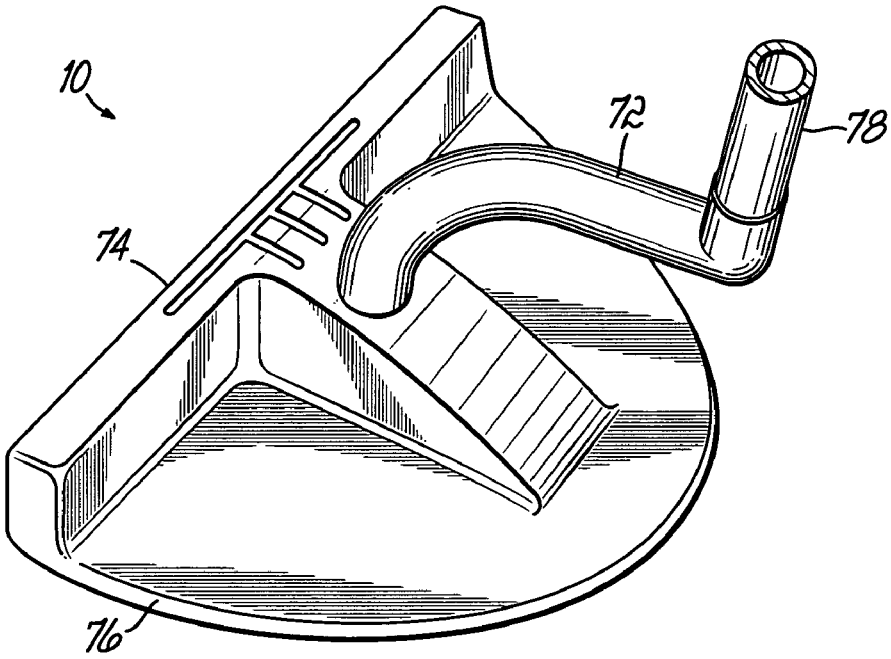
FIG. 16 is a perspective view of another embodiment of a putter.
Figure 17:
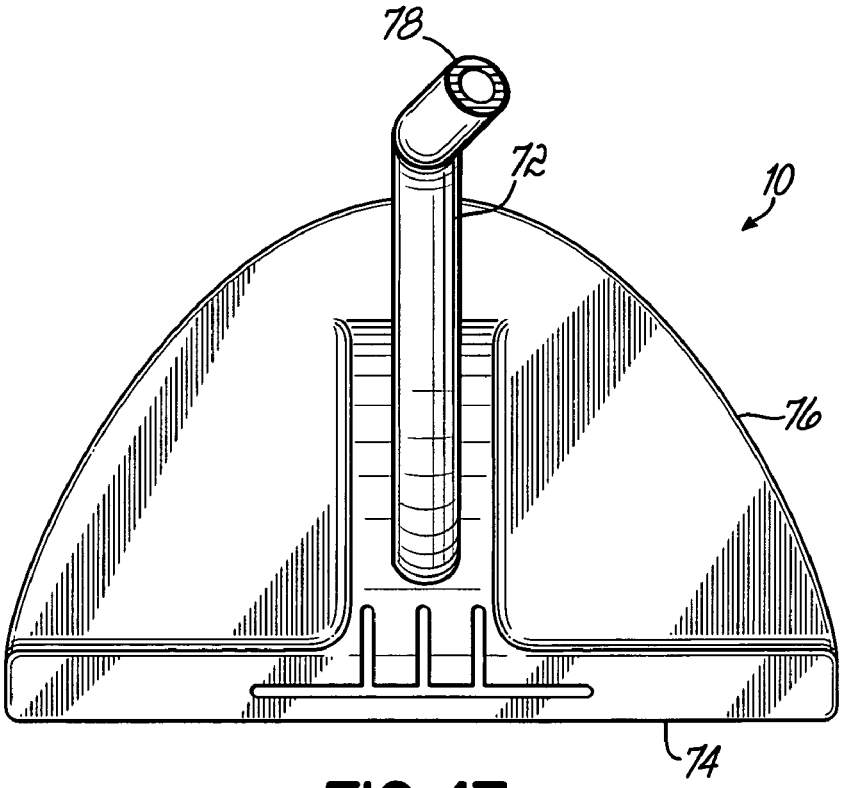
FIG. 17 is a top view of the embodiment shown in FIG. 16.

FIGS. 8–11 illustrate another illustrative embodiment of the invention in the form of a putter head 16" attached to a shaft 12. In these figures, reference numerals with prime marks (') or double prime marks (") refer to structure which is somewhat altered from the corresponding structure denoted with the same numerals and discussed in FIGS. 1–7. Putter head 16" is another mallet-style putter head formed in accordance with the invention having a hosel portion 12*b*' formed with a forward offset. An upper end of hosel 12*b*' attaches to shaft 12 at an angle of preferably 10° from vertical as shown in FIG. 10. Putter head 16" includes a striking face 16*a*" and a stepped rear portion 16*b* providing centralized weight for the putter head 16". Putter head 16" further includes a heel 40 and a toe 42. Preferably, the putter head is moved forward approximately 3 to 5 inches relative to the bottom of the shaft 12 due to the forward offset hosel 12*b*. Preferably, the heel 40 does not intersect with the central longitudinal axis of shaft 12. However, this may not be the case with putter heads of other designs used in accordance with the invention.

Turning to FIGS. 12–15, another putter 50 is shown embodying similar principals to the embodiments described above, but having a different hosel or neck orientation. That is, the hosel or neck 52 curves directly back from the front face 54 of the putter head 56 as shown best in FIG. 15 such that a plane containing the centerline of the hosel or neck 52 is generally perpendicular to the front face 54, or striking face, of the putter head 56. As with the previous embodiments, the shaft 58 is preferably angled at an angle θ of about 10° from vertical, or as described above with respect to the other embodiments. The length of the shaft 58 may vary within conventionally used ranges, for example, and the grip may be a single long grip 60 as shown or two separated grips. Other angles in the 90° range between the orientation shown for the hosel or neck connecting portion 52 and the previous embodiments shown in FIGS. 1–11 may also be chosen. The 10° shaft angle may also be applied to the view shown in FIG. 12 (as opposed to the vertical orientation shown), as shown and described in the next embodiment, such that a compound angle is formed with the shaft additionally angled back away from the front face.

Figure 18:
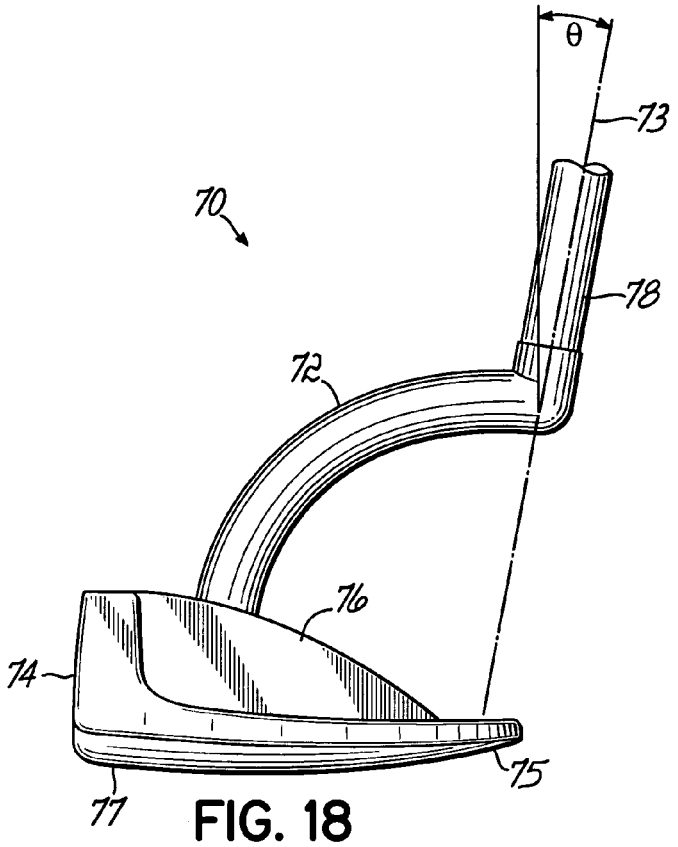
FIG. 18 is a side elevational view of the putter head and neck or hosel of FIG. 16.
Figure 19:
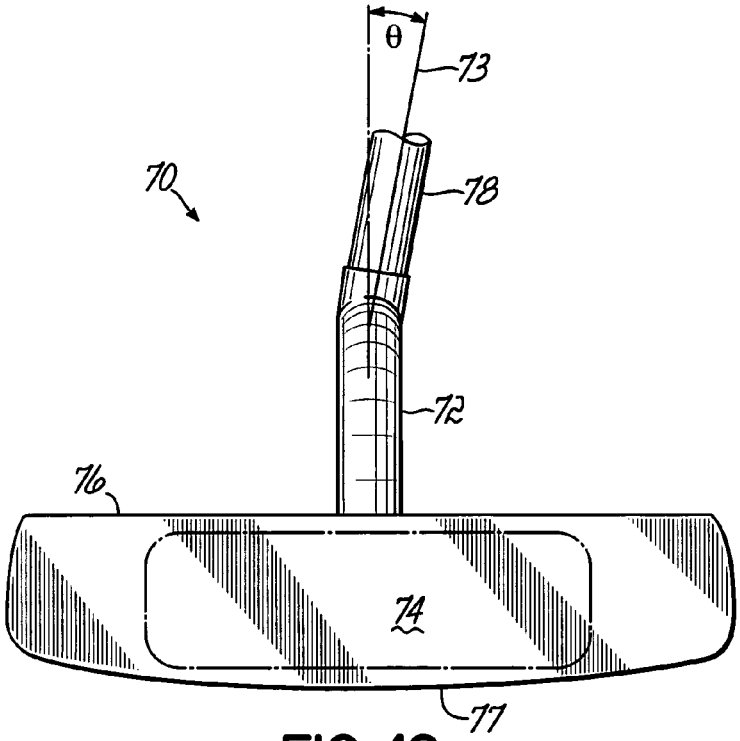
FIG. 19 is a front view of the putter head and neck or hosel of FIG. 16.

FIGS. 16–19 illustrate another putter 70 having a hosel or neck connecting portion 72 curving directly back from the front face 74 of the putter head 76 as shown best in FIG. 18 such that a plane containing the centerline of the hosel or neck 72 is generally perpendicular to the front face 74, or striking face, of the putter head 76. As with the previous embodiments, the shaft 78 has an axis 73 which is preferably angled at an angle θ of at least about 10° from vertical. The axis 73 intersects with a rear portion 75 of the head 76. The bottom surface 77 of the putter head is curved convexly as shown in FIGS. 18 and 19 to help prevent the club head 76 from catching on the ground during the swing. The length of the shaft 78 may vary within conventionally used ranges, for example, and the grip may be a single long grip or two separated grips as previously described. This embodiment may be configured in a manner similar to that described in the embodiment of FIGS. 12–15 and, in addition, the shaft axis 73 forms compound angle with the shaft 78 additionally angled back away from the front face 74 at least 5 degrees. As shown in FIG. 18, the shaft is preferably angled rearwardly approximately 10 degrees.

The preferred embodiment of FIGS. 16–19 is optimally designed to enable the golfer to face the hole from behind the ball and look straight down the line of the putt. The putter head 76 remains on line throughout the entire stroke. The upper end of the connecting portion 72 is angled 10 degrees as shown in FIG. 19 to comply with the rules of golf and also with a rearward angle away from the ball as shown in FIG. 18. This latter angle positions the golf ball out in front of the golfer and promotes a smoother swing plane which should prevent the putter head from hitting the ground at the bottom of the swing both on take away and follow through. Various benefits therefore include: 1) allowing the golfer to face the hole for an undistorted view of the line of the putt; 2) allowing the golfer to line up behind the ball and look straight down the line of the putt; 3) the putter head will remain on line throughout the entire stroke; and 4) the design enables a smooth takeaway and follow through.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus, and illustrative examples shown and described. Accordingly, departures may be made from such details without departing from the spirit or scope of applicant's general inventive concept.

The scope of the invention itself should only be defined by the appended claims, wherein I claim:

1. A golf putter comprising:

a shaft extending along an axis;

a grip on the upper portion of the shaft;

a putter head having a front face adapted to strike a golf ball, a heel portion, a toe portion, a rear portion opposite to the front face, and an upwardly facing mounting surface between the front face and the rear portion; and a connecting portion having a lower end connected to the mounting surface and an upper end coupled with the shaft, wherein the connecting portion extends upwardly and rearwardly from the lower end to the upper end in a direction generally perpendicular to the front face of the putter head and the upper end of the connecting portion is located rearward of the lower end, wherein the connecting portion is a single continuous curve extending from the upper end to the lower end, the single continuous curve having an inside portion facing downward and an outside portion facing upward when the putter is at address.

2. The golf putter of claim 1, wherein the axis of the shaft extends at least 10 degrees from vertical and in a plane generally parallel to the front face when the putter is at address with a bottom surface of the putter head disposed in a horizontal orientation.

3. The golf putter of claim 2, wherein the axis of the shaft extends at least approximately 5 degrees from vertical and in a plane generally perpendicular to the front face when the putter is at address with a bottom surface of the putter head disposed in a horizontal orientation.

4. The golf putter of claim 1, wherein the putter shaft is connected to a central area of the head.

5. The golf putter of claim 1, wherein the axis of the shaft intersects with the rear portion of the putter head.

* * * * *